US005544886A

United States Patent [19]

VanSkiver

[11] Patent Number: 5,544,886

[45] Date of Patent: Aug. 13, 1996

[54] GOLF PRACTICE DEVICE

[76] Inventor: David VanSkiver, 1109 Beaumont Ave., Port Charlotte, Fla. 33948

[21] Appl. No.: 499,184

[22] Filed: Jul. 7, 1995

[51] Int. Cl.[6] ..... A63B 69/36

[52] U.S. Cl. ..... 473/143; 473/147; 473/280

[58] Field of Search ..... 273/185 C, 200 R, 273/200 A, 199 A, 184 B, 58 C

[56] References Cited

U.S. PATENT DOCUMENTS

| | | | |
|---|---|---|---|
| 1,507,904 | 9/1924 | Aston . | |
| 3,298,232 | 1/1967 | Carboni | 273/185 C |
| 3,425,700 | 2/1969 | Edwards | 273/185 C |
| 4,022,476 | 5/1977 | Barton | 273/185 C |

FOREIGN PATENT DOCUMENTS

| | | |
|---|---|---|
| 3621330A1 | 1/1988 | Germany . |
| 206579 | 11/1923 | United Kingdom . |

*Primary Examiner*—George J. Marlo
*Attorney, Agent, or Firm*—Frank A. Lukasik

[57] ABSTRACT

A system for enabling golf practice to be held in a limited space including:

a cylindrical, PVC, pipe casing containing weight means and having a first end with an end cap fastened thereon, an eye bolt fastened to said first end cap, and a second end having an end cap fastened thereon, forming a sealed container for said weight means, a golf ball having a bore formed therethrough at the diameter, said bore countersunk at one end, and a tethering cord having a first end and a second end, said cord secured at said first end to said golf ball, said cord passing through said bore and secured therein, and shaped to conform to the outer surface of said golf ball at said first end, and said tethering cord secured at a second end to said eye bolt, said second end passing through said eye bolt, and secured to itself by a clamp, thereby forming a loop, whereby when said golf ball, said cord and said pipe casing are strung out in alignment and said ball is struck by a golf club, said ball will travel along its natural trajectory until restrained by said weighted pipe casing, thereby allowing viewing of at least the initial portion of the trajectory of said ball and enabling said ball to travel substantially double the distance of the length of said cord.

3 Claims, 3 Drawing Sheets

GOLF PRACTICE DEVICE

BACKGROUND OF THE INVENTION

1. Field of the Invention

This invention relates to a golf practice device adapted for backyard use which permits hitting a substantially normal ball that is tethered to a weight sufficient to be moved only slightly when the ball is struck in a full swing. The ball preferably is made of plastic and has a hole, drilled through its diameter, in which the tether and an optional chemiluminescent rod are received.

2. Description of the Prior Art

Several types of practice golf balls have been in use for years, including cloth balls, whiffle balls, and a shuttlecock tied to a golf ball among other species. These prior devices have various deficiencies but the most prominent of the deficiencies is the lack of feel of striking a normal or substantially normal ball coupled with the lack of being able to see the ball in at least the initial portion of its flight. For example, U.S. Pat. No. 1,507,904, (U.K. Patent No. 206, 579) to Aston discloses a captive golf ball made of rubber and having a flexible tail, with the exterior surface of the ball and the tail being formed all in one piece of the same material. The tail is secured in the tee at one end and is shown of tapering form increasing towards the ball at its outer end. The tail may have its outer end flared so as to merge into the curved surface of the ball. A piece of lead is secured around the tail end adjacent to the tee to further retard the flight of the ball.

German Patent No. 3,621,330 concerns a golf ball tethered to a lightweight object that is configured to present significant air resistance. The tether may be made of either twine or elastic cord.

It can readily be appreciated that these references, either singly or in combination, do not suggest or infer the golf practice device of present invention which provides for a flight-limiting tether that nevertheless allows the user to observe the initial flight of the ball while still restricting the distance the ball may be driven. Reviewing the cited patents, in Aston the flexible tail is long and cumbersome and, in addition, the tee is not secured in the ground so that all three elements, i.e. the tee, ball and tether are launched together. Since the distance these elements may fly is uncertain, this device could not be used for backyard practice. The device in Uberla et al also is unsuited for backyard practice since, again, the distance which the three elements, namely, the ball, the twine and the lightweight object may travel is uncertain. In addition, the relatively large lightweight object should necessarily affect the trajectory of the shot and the short tether should preclude viewing the height and direction of the ball.

SUMMARY OF THE INVENTION

Accordingly, it is an object of the present invention to provide a golf practice device that will permit the practice of all shots within one's own backyard while using the equivalent of a normal golf ball.

It is another object of the invention to provide such a device that includes a flight-limiting tether which nevertheless allows the user to observe the initial flight of the ball.

It is a still further object of the invention to provide such a practice device that will permit viewing the initial height and direction of the ball while still restricting the distance the ball may be driven.

It is yet another object of the invention to provide a golf practice device having a tether of sufficient length to permit following the ball for substantially the first 30 feet of flight while remaining within the confines of the golfer's backyard, with the distance variable in relation to the area of the backyard.

The foregoing objects are realized by the present invention in a system wherein a golf ball is tethered to a weight of substantially 3.5 pounds using a woven nylon cord at least 12 to 15 feet in length. The golf ball preferably is made of plastic and has a hole drilled along its diameter through which the nylon cord is threaded and knotted at its end. In an alternative embodiment, the hole may be made larger to receive both the cord and a chemiluminescent rod for practice at night.

BRIEF DESCRIPTION OF THE DRAWINGS

The foregoing and further objects of the invention will become apparent from reading the following detailed description of preferred embodiments of the invention, in which.

DETAILED DESCRIPTION OF THE INVENTION

Figure 1:
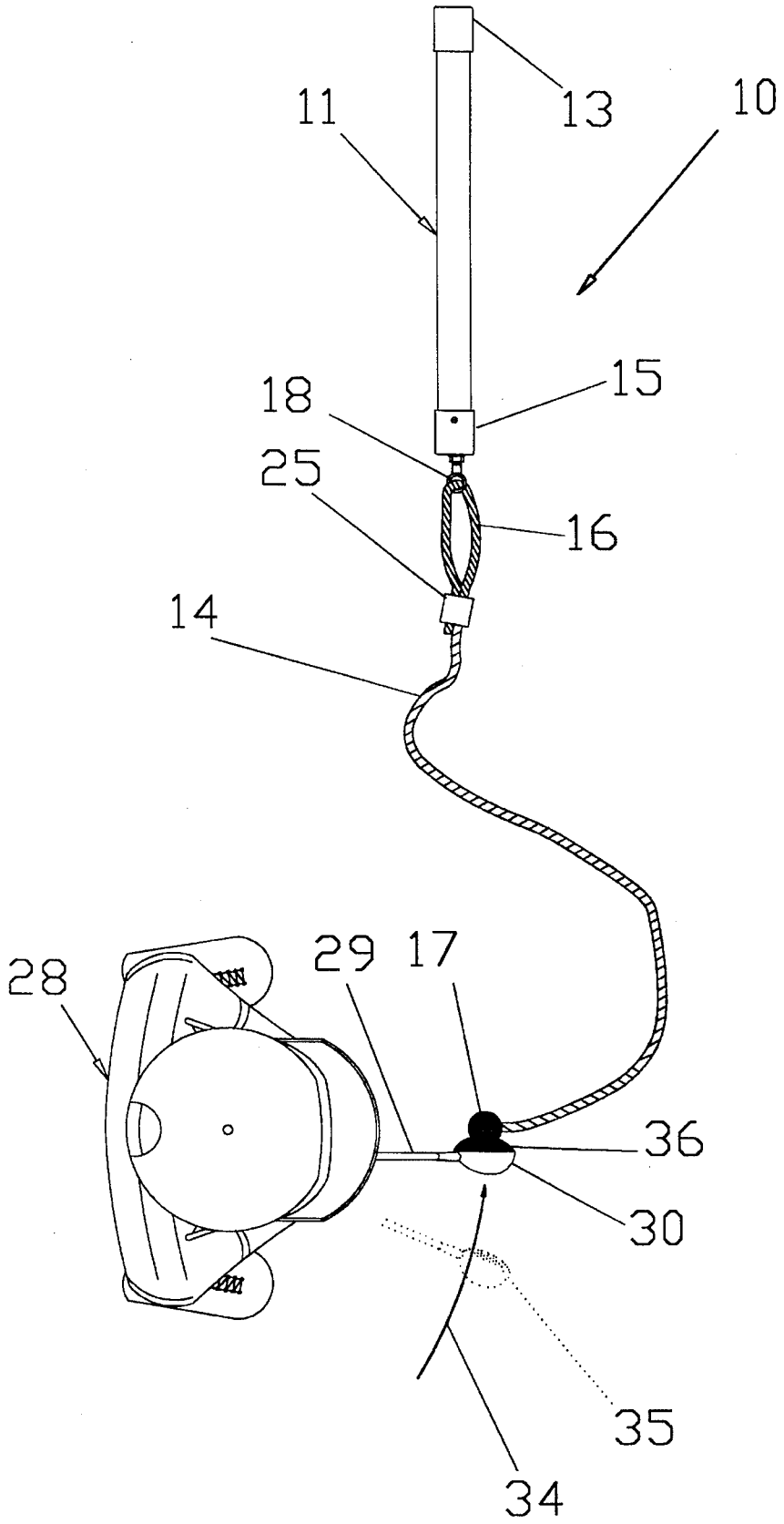
FIG. 1 is a top perspective view of the invention in position for use.

Turning now to FIG. 1 of the drawings, there is shown a preferred embodiment of the invention 10 comprising a PVC pipe casing 11 having an end cap 13 at one end and a ⅜" diameter nylon cord 14 secured to an end cap 15 at the other end. Cord 14 is connected to end cap 15 at one end preferably by means of a loop 16 and is secured to a golf ball 17 at he other end. Cord 14 is passed through an eye bolt 18 to form loop 16 and the cord 14 is seized to itself by a standard rope clamp 25. A golfer 28 is shown in the act of swinging a club 29 having a clubhead 30, with the clubhead 30 following an arc 34 through a position 35 to the point of striking the ball at 36.

Figure 2:
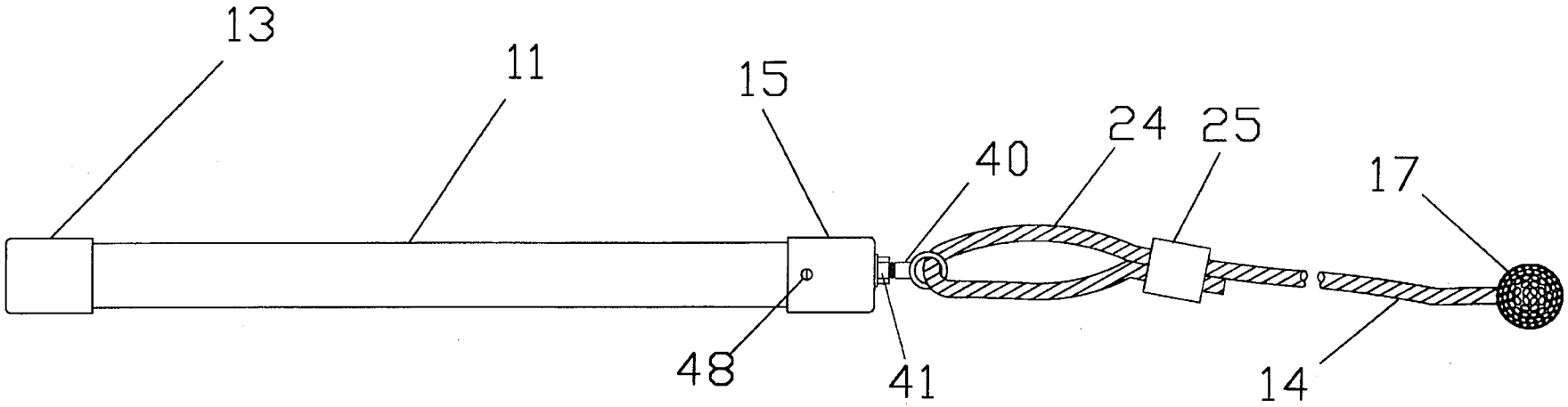
FIG. 2 is a plan view, partially cutaway, of the embodiment of FIG. 1.

FIG. 2 is an exploded view of the embodiment shown in FIG. 1 and illustrates the manner in which loop 16 is secured to cap 15 via eye bolt 18 and a locknut 41.

Figure 3:
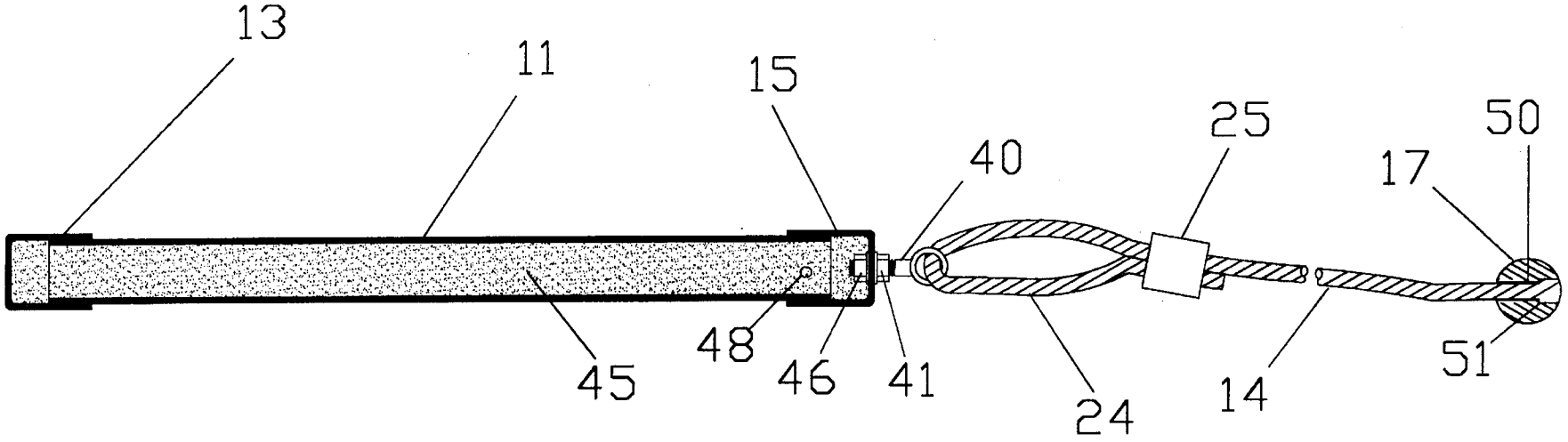
FIG. 3 is a sectional view of the embodiment of FIG. 2.

FIG. 3 illustrates in greater detail the construction of specific components of the embodiment of FIG. 1. PVC casing 11 is shown with end cap 13 glued thereto with PVC glue and end cap 15 is drilled to provide for insertion of eye bolt 18 therein. Exterior locknut 41 and an interior locknut 46 are then tightened to secure the eye bolt 18 in place after which cap 15 is glued or bolted to caising 11 and the cap 15 and casing 11 are bored to receive a retaining bolt 48. Ball 17 is bored as indicated at 50 and countersunk as indicated at 51 to receive cord 14 which is knotted, forced into countersink 51 and made flush with ball 17. The opposite end of cord 14 is passed through the eye of eye bolt 18 and secured to itself by clamp 25. A grass driving surface is also provided but it is not essential to the invention.

In operation, as shown in FIG. 1, the golfer 28 tees up ball 17 with the knot at countersink 51 facing him and casing 11 aligned with the expected trajectory of the ball 17. When the ball 17 is hit, it will travel a linear distance of substantially double the length of cord 14, that is, if the cord is 15 feet in length it will travel substantially 30 feet, allowing the golfer to observe at least the initial 15 feet of the ball's trajectory. When the ball is at the end of double the cord length, casing 11 is pulled only slightly along the ground because of its weight and shape, thereby acting as a shock absorber which also prolongs the life of the cord or an optional, thicker material such as rope.

Although this invention has been disclosed and described generally in relation to a preferred embodiment, its principles are susceptible of other applications which will be apparent to persons skilled in the art. For example, cord 11 and ball 17 may be made of similar polymeric materials so that the knot in countersink 51 may be bonded thereto preferably by the application of heat, and casing 11 and end caps 13 and 15 may likewise be bonded together. Hence, many modifications, additions, and deletions may be made to the invention without departure from the scope of the invention as set forth in the following claims:

What is claimed is:

1. A system for enabling golf practice to be held in a limited space, said system comprising:

a cylindrical, PVC, containing weight means and having a first end with an end cap fastened thereon, an eye bolt fastened to said first end cap, and a second end having an end cap fastened thereon, forming a sealed container for said weight means, a golf ball having a bore formed therethrough at the diameter, said bore countersunk at one end, and a tethering cord having a first end and a second end, said cord secured at said first end to said golf ball, said cord passing through said bore and secured therein, and shaped to conform to the outer surface of said golf ball at said first end, and said tethering cord secured at a second end to said eye bolt, said second end passing through said eye bolt, and secured to itself by a clamp, thereby forming a loop, whereby when said golf ball, said cord and said pipe casing are strung out in alignment and said ball is struck by a golf club, said ball will travel along its natural trajectory until restrained by said weighted pipe casing, thereby allowing viewing of at least the initial portion of the trajectory of said ball and enabling said ball to travel substantially double the distance of the length of said cord.

2. The system of claim 1 wherein said pipe casing contains sufficient weight to restrain movement thereof and to permit movement a selected short distance after said cord has been extended to its full length when said ball is struck.

3. The system of claim 2 wherein said cord and said ball are made of polymeric material, said cord being knotted and contained in said countersunk portion of said core, said knotted portion of said cord being melted in said countersunk portion.

* * * * *